US006263889B1

(12) United States Patent
Flynn et al.

(10) Patent No.: US 6,263,889 B1
(45) Date of Patent: Jul. 24, 2001

(54) ENGINE LUBRICATION CLEANING SYSTEM

(76) Inventors: Robert A. Flynn, 2470 Beechwood Dr., Paso Robles, CA (US) 93446; Robert E. Flynn, 953 N. Greer Ave., Covina, CA (US) 91724

( * ) Notice: Subject to any disclaimer, the term of this patent is extended or adjusted under 35 U.S.C. 154(b) by 0 days.

(21) Appl. No.: 09/184,107

(22) Filed: Nov. 2, 1998

(51) Int. Cl.[7] ..... B08B 9/08
(52) U.S. Cl. ..... 134/102.2; 134/111; 134/169 A
(58) Field of Search ..... 134/169 A, 102.2, 134/111, 10, 22.18

(56) References Cited

U.S. PATENT DOCUMENTS 2,665,772 * 1/1954 Greer et al. ..... 134/169 A X
4,884,660 12/1989 Bedi .
4,951,784 8/1990 Bedi .
4,991,608 * 2/1991 Schweiger ..... 134/102.2 X
5,044,334 9/1991 Bedi .
5,048,578 * 9/1991 Dorf et al. ..... 141/346
5,190,120 3/1993 Watts .
5,460,656 * 10/1995 Waelput et al. ..... 134/169 A X

* cited by examiner

*Primary Examiner*—Philip R. Coe
(74) *Attorney, Agent, or Firm*—Boniard I. Brown

(57) ABSTRACT

An engine oil system cleaning apparatus has a cleaning solution delivery line connected by an adapter to a running engine, and an exit line and a return line from the engine connected at an adapter at the engine oil pan. A fail-safe loop flow circuit, including the exit line and solution delivery line, is provided upon sensing of a pressure drop in the delivery line to operate valves to effect flow through the fail-safe circuit.

13 Claims, 3 Drawing Sheets

ENGINE LUBRICATION CLEANING SYSTEM

BACKGROUND AND SUMMARY OF THE INVENTION

Internal combustion engine internal cleaning and engine oil system cleaning have long been known, as have the benefits of periodic cleaning, these benefits including extended engine life, emission reduction, reduction of needed repairs, and reduced frequency of oil changes.

Cleaning methods and equipment heretofore utilized have generally involved cleaning in a static mode, with the engine not running. Such processes do not clean as thoroughly as does dynamic cleaning, with the engine running. Modern high-speed engines operate at higher temperatures, and produce more sludge and varnish than earlier engines, these requiring improved cleaning methods to achieve good results.

The system of the present invention performs a dynamic oil cleaning operation with the engine running and, optionally, static cleaning with engine not running. In the dynamic mode of cleaning, cleaning is essentially complete including cleaning of the oil pump, engine passages, galleys, check valves, oil screen, etc. In the prior art, such cleaning has often involved disassembly of engine components.

Utilizing the system of the invention, all internal surfaces which are oil-wetted during engine operation are cleaned, including such components as valve covers and all internal non-pressurized sources which contact lubricating oil. In conventional static mode cleaning, only surfaces which are pressurized are adequately cleaned. The system removes more sludge, varnish and metallic particles than are removed by prior art conventional systems.

With the engine operating during the dynamic cleaning process, cleaning solution is splashed onto all contaminated surfaces which in engine operation are in contact with lubricating oil. The cleaning solution washes and flushes away the contaminants to the engine oil pan from which they are removed in the operation of the system of the invention.

The advantages provided include extended engine life, fewer oil changes, decreased engine maintenance requirements and repairs, improved fuel economy, and better engine performance.

The application of air-injection pressure with the system of the invention enhances the cleaning effects, and provides compression of a filter element to remove contaminants, enabling repeated use of the same filter element, with elimination of the labor of changing filters and possible spillage. The solution can clean up to ten or fifteen engines.

The system includes a solution delivery line wherein are disposed devices including a pump, a unidirectional valve, and a low pressure-sensitive device, a solution exit line for solution pumped by the engine pump from the engine, and a solution return line to a solution reservoir. A fail-safe loop flow circuit is activated in the event of a pressure drop in the solution delivery line to the engine, by means of a sensing device in the delivery line activating to close and open valves in the exit line and solution return line.

DESCRIPTION OF THE PREFERRED EMBODIMENT

Figure 1:
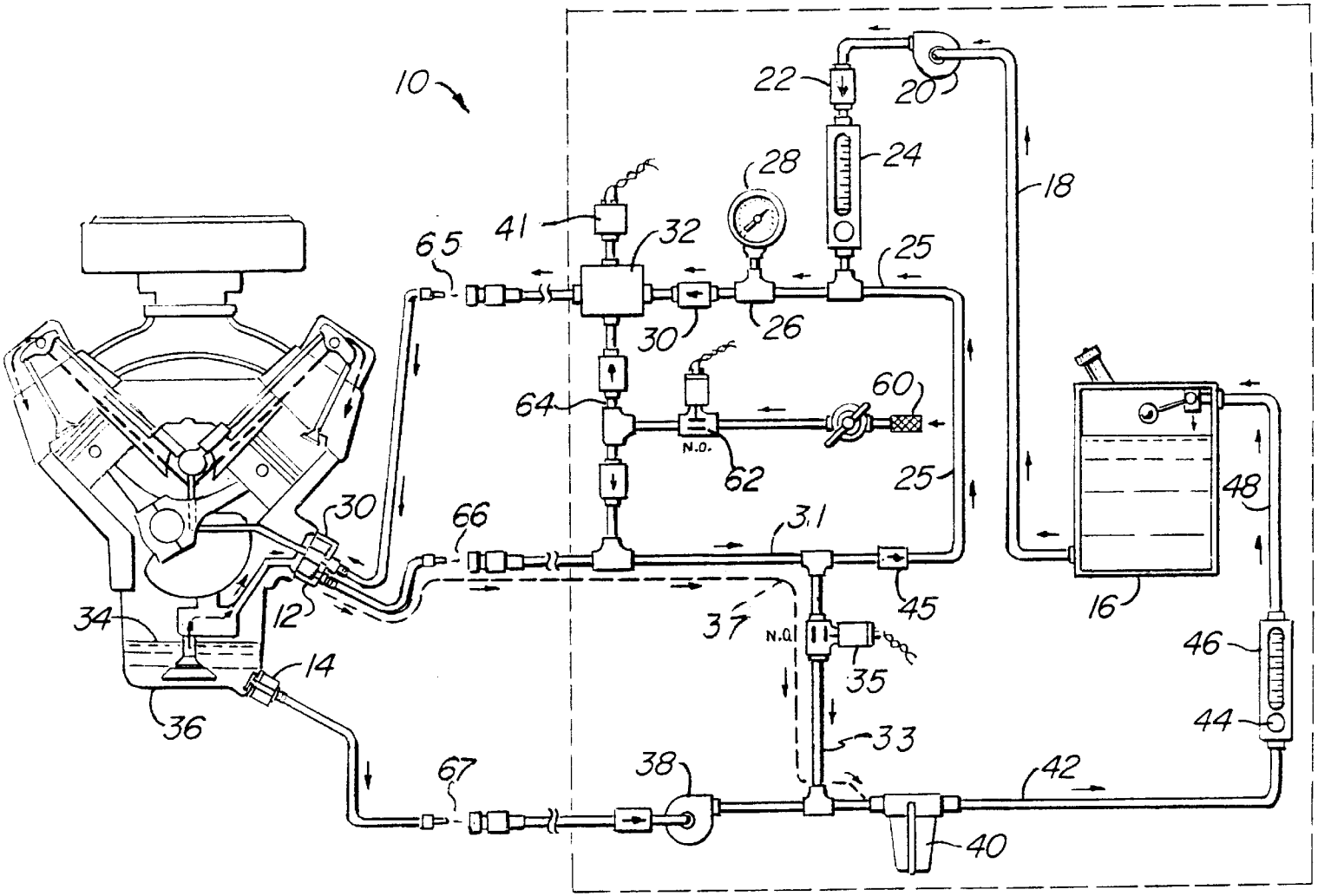
FIG. 1 is a generally schematic illustration of the flow lines and operational devices utilized with the present invention.
Figure 2:
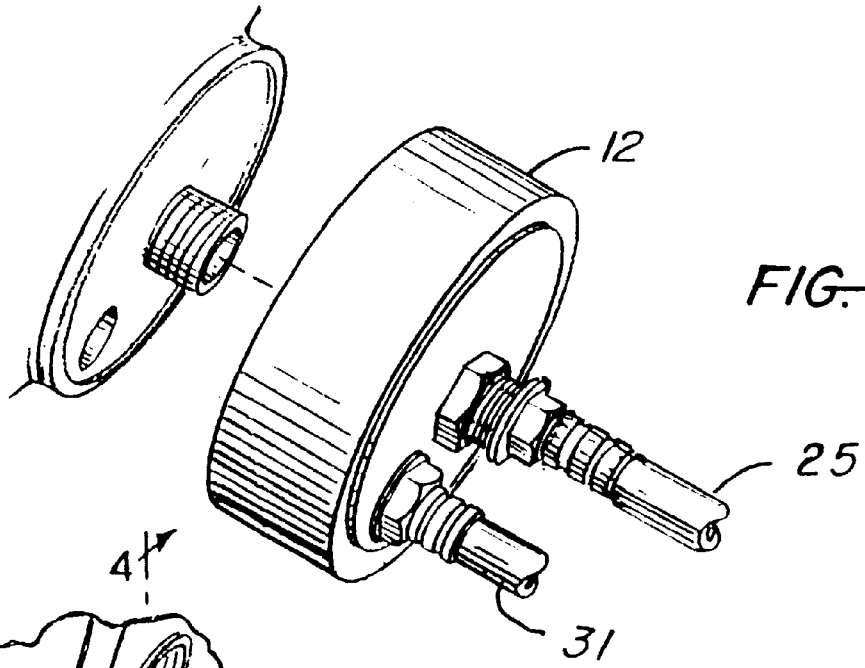
FIG. 2 is a perspective view of an oil filter adapter utilized with the present invention.
Figure 3:
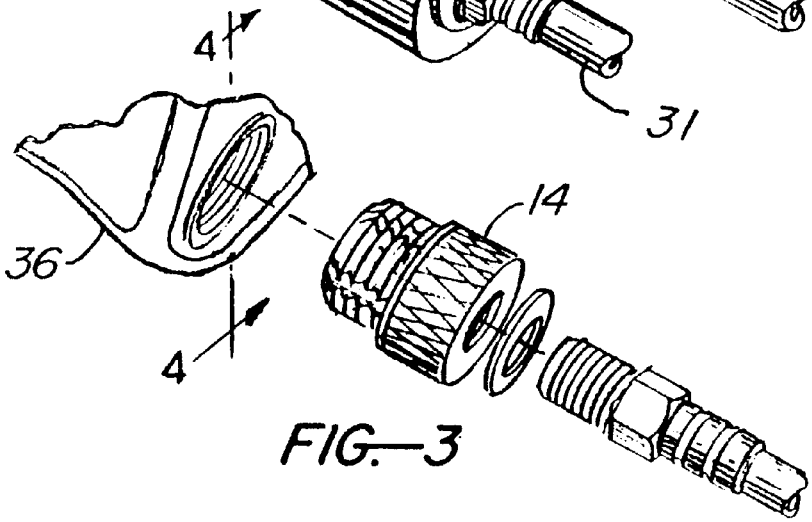
FIG. 3 is an exploded perspective view of an oil pan adapter utilized with the invention.
Figure 4:
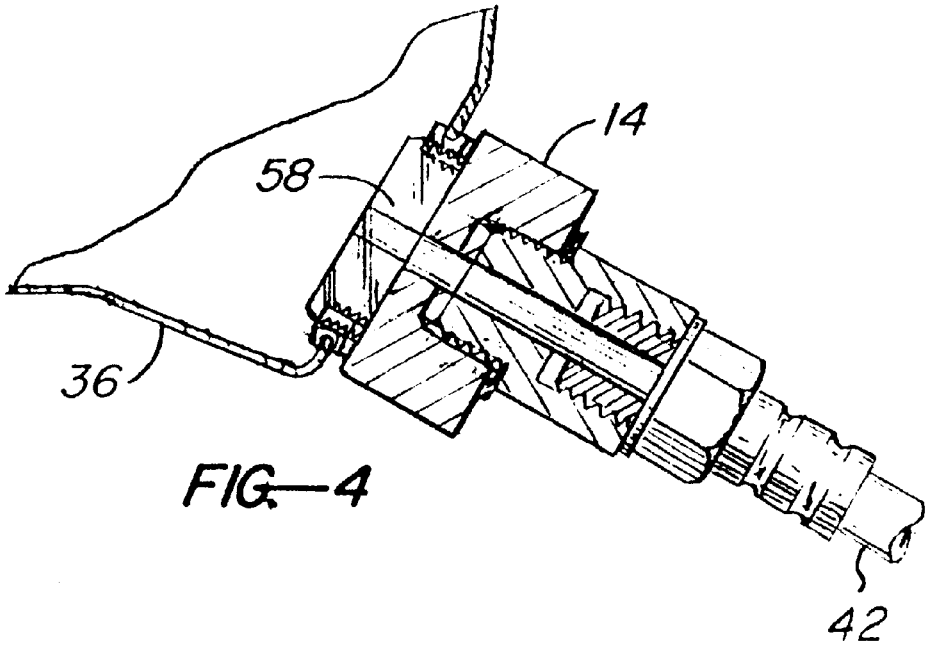
FIG. 4 is an elevational view, partially in section, of an oil pan adapter utilized with the invention.
Figure 5:
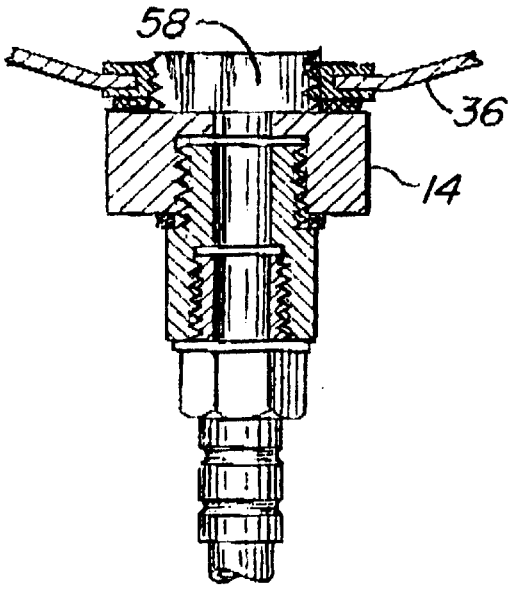
FIG. 5 is an elevational view, partially in section, slowing details of the oil pan adapter of FIG. 4.

Referring to the drawings, there is shown an engine lubricating system cleaning apparatus 10 of the invention. The cleaning system is operable either in a preferred dynamic mode, with the engine operating at idle speed, or in a static mode with the engine not operating.

In the dynamic mode, the engine is operated at idle speed and a solution comprising a mixture of lubricating oil and cleaning solvent is circulated through the engine to reach and clean all surfaces which are contacted by engine lubricating system oil in the operation of the engine.

In preparation for an engine cleaning operation, the engine oil filter is removed from its threaded opening and a filter adapter 12 is threadedly mounted in the engine oil filter opening; and an oil pan adapter 14 is threadedly mounted in the oil pan drain plug opening and has a passage therethrough for outward passage of cleaning fluid, as shown in lower portion of FIG. 1. A first oil filter adapter 12 has two passages therethrough, one connected with a solution delivery line for inflow of solution to the engine interior, and a second passage connected with the engine oil pan and with line 31 for outflow of cleaning solution helped by the engine oil pump. The oil filter adapter may be provided in a plurality of thread sizes to accommodate a variety of openings and thread sizes of various automobile manufacturers.

The adapters 12, 14 are connected by conventional fittings to fluid solution flow lines of the cleaning system.

The cleaning system comprises a solution reservoir or tank 16, a line 18 through which, in the dynamic mode of operation, solution is drawn by a pump 20 which pumps solution through a one-way valve 22, a flowmeter 24, in a flow line 25, and thence past a pressure gauge 28 on a T-connection 26. Solution then passes through a one-way valve 30 to a junction block connector 32, and thence through a continuation of line 25 to the engine via the adapter 12.

In the static mode of system operation, with the engine not running, the solution is pumped through the engine by the solution pump.

The cleaning solution effects cleaning throughout the engine interior, and reaches all parts and surfaces which are normally subject to being wetted by engine lubrication oil during engine operation.

With the engine oil pump operating in the dynamic mode throughout the cleaning process, it assists in providing fail-safe lubrication in the event of any failure of the system to otherwise pump solution to operate the cleaning system.

Cleaning solution pumped by the engine oil pump passes via adapter 12, through an exit line 31 and a connecting exit line 33, the flow path being indicated by broken line 37 (FIG. 1), and thence to a return line 42, 48 to the solution reservoir 16. Continuous flow of cleaning solution is thus normally provided throughout the cleaning process in the dynamic mode.

Valve 35 is normally open to allow fluid flow into line 42. When system pressure drops below a predetermined pressure, as in line 25, pressure sensitive switch 41 sends a signal to close valve 35 and divert fluid from line 25 back into the engine and not to reservoir 16.

In the event that pressure in solution delivery line 25 drops below a predetermined pressure, for example, a drop to 7 psi., a pressure-sensitive device, a switch or transducer 41, provides an electric signal to close a normally open solenoid valve 35 in line 33. The resulting increased pressure in exit line 31, typically from 40 psi. to 60 psi., opens a unidirectional valve 45, the opening pressure of which may typically be 60 psi. Solution flow is thereby directed via the valve 56 through delivery line 25 into the engine via adapter 12, the cleaning solution passing from the engine via exit line 31 and connecting line 33 to the solution return line 42, and thence to the solution reservoir.

In an alternate arrangement, a solenoid valve (not shown) is substituted for the unidirectional valve 45, and opens in response to the electrical signal from the pressure-sensitive device 41 to permit flow through line 25 to the engine.

There is thus provided an alternate closed-loop cleaning solution flow circuit, which is independent of the solution delivery pump 20, and which provides a back-up fail-safe flow circuit in the event of failure of pump 20 to provide sufficient pressure for flow of cleaning solution to the engine.

In addition to the electrical signal from the pressure-sensitive device switch 41 opening valve 45 and closing the valve 35, it activates a buzzer and a lamp signal to indicate pressure in delivery line 25 has dropped to a predetermined low pressure of, typically, 7 psi.

Cleaning solution is continuously pumped through the engine for a period of, typically, about 15 minutes, at the end of which period a lamp or buzzer signals the end of the cleaning operation.

If the system operation does not maintain a desired operating cleaning solution level in the engine crankcase 36, a suction pump 38 in the solution delivery line is activated upon an operator observing the level at the operating console. As an example if 11 gals. of solution are pumped into the engine, the suction pump 38 is activated by the operator to pump solution from the oil pan to maintain, typically, a 1 gal. level in the crankcase oil pan. This is accomplished by operation of needle valve 44 upstream of a flowmeter 46 between solution return lines 42 and 48.

In the dynamic mode, the system provides effective cleaning and washing action. All engine components, reachable by lubricating oil during normal engine operation, are cleaned, these including such components as rocker arms various moving components, etc., while these components are in motion.

In the static mode of operation, the engine is not running, and solution pump 20 pumps solution through the engine. There is no flow from the engine crankcase via solution return line 42 to reservoir 16. The adapter 12 is not required for static operation, and may be replaced by a simple threaded plug insert. In the static mode of operation, a "bubbling" action is provided by solution in contact with engine components, thus providing some agitation for enhanced cleaning, with the engine not running.

In comparison with conventional cleaning systems, the system of the invention removes essentially all cleaning solution and contaminants from the engine. Whereas conventional cleaning methods remove only about 3½ qts. of solution, the present invention removes substantially all cleaning solution from the engine.

After an engine cleaning operation, pump 20 in the solution delivery line is deactivated, and the suction pump 38 is activated to draw cleaning solution from the engine crankcase to the reservoir 16.

Figure 6:
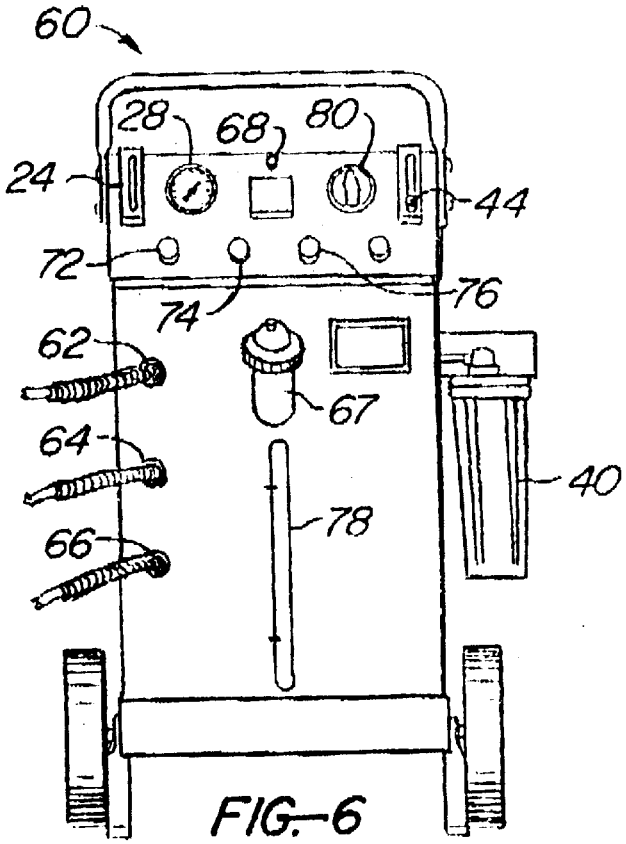
FIG. 6 is an elevational view of an operating console utilized with the invention.

Application of air pressure to the system may preferably be utilized, and is introduced at air inlet 60 from an external source. The pressurized air passes through a valve 62, normally a solenoid-operated valve, to a line 64 which extends between the solution input line 25 and the exit line 31 (FIG. 1), as shown. Application of pressurized air serves three purposes or functions. First, the pressurizing of the engine interior assists in removal of cleaning solution therefrom, thereby removing perhaps an additional quart of solution which might otherwise remain in the engine. Second, in the static mode of operation, air pressure enhances the cleaning action by its application to solution entering the engine. Third, the air pressure exerts a compressing action on a filter element in the filter 40 in the solution return line. The filter may be typically a 5 micron filter, but may be a 1 micron filter. The air pressure compression of the filter element substantially clears carbon and other materials cleaned from the engine by the removal of as much as 2 qts. of dirty cleaning solution from the filter. This enable re-use of the filter without removing the filter from its housing or unscrewing of the cover, etc., as otherwise required. The spilling of dirty solution is eliminated, as is the frequent changing of filters.

a console, preferably utilized with the system of the invention, is shown in FIG. 6. As indicated in FIGS. 1 and 6, solution delivery line, the exit line, and the solution return line, have respective connections at a wall of the console at 66, 66, and 67.

For efficiency and convenience of operation, by an operator, there are mounted on the console the pressure gauge 28, the flowmeter 24, flowmeter 44, and the filter 40. The console also mounts an indicator lamp 68, actuating buttons, including low pressure and pump buttons 72, 74, which 76, and a solution input component 67, and crankcase solution level indicator 78, as shown.

Thus there has been shown and described an engine lubrication cleaning system which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventors claim:

1. An engine oil system cleaning apparatus, comprising:

a solution delivery line having one end connected with a cleaning solution reservoir and an opposite end connected with the engine interior, a pump for pumping solution via the solution delivery line from the solution reservoir to the engine interior, a solution drain line having one end connected with an engine oil pan and an opposite end connected with the cleaning solution reservoir, a pressure sensitive device in the solution delivery line to generate a signal in response to a predetermined pressure drop in the solution delivery line, a filter and an exit line connected with the engine interior and with the solution drain line to conduct to the solution reservoir cleaning solution pumped by the engine oil pump, a return valve disposed in a solution return line and adapted to close in response to said signal from the pressure-sensitive device, and a loop valve disposed between the exit line and the solution return line and adapted to open upon said signal from the pressure-sensitive device and closure of the return valve to pass solution to the solution delivery line to the engine, whereby a closed loop fail-safe cleaning solution flow circuit is provided, comprising the exit flow line, the solution return line, and the engine pump to maintain cleaning solution flow to and from the engine in the event of a predetermined pressure drop in the cleaning solution delivery line.

2. Apparatus according to claim 1, and wherein:

said loop valve is a unidirectional valve adapted to open upon the pressure sensitive device signal and increase of line pressure to a predetermined opening pressure.

3. Apparatus according to claim 1, wherein said loop valve is a solenoid valve responsive to said signal from the pressure-sensitive device to open the valve.

4. An engine oil system cleaning apparatus, comprising a solution delivery line having one end connected with a cleaning solution reservoir and an opposite end connected with the interior of the engine, pump means to pump solution from the solution reservoir to the engine interior, a solution return line connected with the engine and with the solution reservoir, a filter connected with the engine interior and with the solution return line by an exit line to conduct cleaning solution pumped by the pump means to the solution reservoir, whereby continuous flow of solution is provided to and from the engine during an engine cleaning operation, an input connection to an external source of pressurized air, an air line between the solution delivery line and the exit line, and a control valve operable to control admission of pressurized air to the air line, the solution delivery line and the exit line, whereby the air pressure is applied to cleaning solution in the engine and in the solution delivery line to provide enhanced engine cleaning action, and to compress a filter cartridge in the solution return line to remove dirty solution therefrom to facilitate re-use of the filter element without change of filters.

5. Apparatus according to claim 1, and further including an air pressurizing system, comprising:

an input connection to an external source of pressurized air, an air line between the solution delivery line and the exit line, a control valve operable to control admission of pressurized air to the air line, the solution delivery line, and the exit line, whereby the air pressure is applied to cleaning solution in the engine and in the solution delivery line to provide enhanced engine cleaning action, to compress a filter cartridge in the solution return line to remove dirty solution therefrom facilitate re-use of the filter element without change of filters.

6. Apparatus according to claim 1, and further comprising:

a first adapter disposed in an engine oil filter opening, said first adapter having a first passage connected with the solution delivery line to admit cleaning solution into the engine, and having a second passage to pass from the engine cleaning solution pumped by the engine fuel pump, and a second adapter disposed in an engine oil pan opening and having a passage therethrough connected with the solution return line.

7. Apparatus according to claim 6, wherein:

said second adapter has therein a slot transversely of said passage therein, said slot having a bottom wall at about the level of the adjacent wall of the oil pan to facilitate passage of substantially all cleaning solution from the oil pan through the adapter passage.

8. An engine oil system cleaning apparatus, comprising:

a solution delivery line having one end connected with a cleaning solution reservoir and an opposite end connected with the engine interior.

a pump in the solution delivery line for pumping solution via the solution delivery line from the solution reservoir to the engine interior, a solution drain line having one end connected with an engine oil pan and an opposite end connected with the cleaning solution reservoir, a pressure sensitive device in the solution delivery line to generate a signal in response to a predetermined pressure drop in the solution delivery line, a filter and exit line connected with engine interior and with the solution drain line to conduct to the solution reservoir cleaning solution pumped by the engine oil pump, a return valve disposed in a solution return line and adapted to close in response to said signal from the pressure-sensitive device, and a loop valve disposed between the exit line and the solution return line and adapted to open upon said signal from the pressure-sensitive device and closure of the return valve to pass solution to the solution delivery line to the engine, whereby a closed loop fail-safe cleaning solution flow circuit is provided, comprising the exit flow line, the solution return line, and the engine pump to maintain cleaning solution flow to and from the engine in the event of a predetermined pressure drop in the cleaning solution delivery line.

9. Apparatus according to claim 8, wherein:

said loop valve is a unidirectional valve adapted to open upon the pressure sensitive device signal and increase of line pressure to a predetermined opening pressure.

10. Apparatus according to claim 8, wherein:

said loop valve is a solenoid valve responsive to said signal from the pressure-sensitive device to open the valve.

11. Apparatus according to claim 8, and further comprising:

a first adapter disposed in an engine oil filter opening, said first adapter having a first passage connected with the solution delivery line to admit cleaning solution into the engine, and having a second passage to pass from the engine cleaning solution pumped by the engine fuel pump, and a second adapter disposed in an engine oil pan opening and having a passage therethrough connected with the solution return line.

12. Apparatus according to claim 1, wherein:

said engine oil system cleaning apparatus is operable (1) in a dynamic mode with a vehicle engine running and having a return line connecting the engine with a solution reservoir, (2) in a static mode wherein the engine is not running, and having no line connecting the engine with the solution reservoir.

13. Apparatus according to claim 8, wherein:

said engine oil system cleaning apparatus is operable (1) in a dynamic mode with a vehicle engine running and having a return line connecting the engine with a solution reservoir, (2) in a static mode wherein the engine is not running, and having no line connecting the engine with the solution reservoir.

* * * * *